US005288382A

United States Patent [19]

Shinogi et al.

[11] Patent Number: 5,288,382

[45] Date of Patent: Feb. 22, 1994

[54] OPTICAL FINE PROCESSING APPARATUS

[75] Inventors: Masataka Shinogi; Toshihiko Sakuhara; Masayuki Suda; Fumiharu Iwasaki; Akito Ando, all of Tokyo, Japan

[73] Assignee: Seiko Instruments, Inc., Tokyo, Japan

[21] Appl. No.: 38,510

[22] Filed: Mar. 29, 1993

[30] Foreign Application Priority Data

Mar. 30, 1992 [JP] Japan ..... 4-74732

[51] Int. Cl.[5] ..... C25D 17/00; C25F 7/00

[52] U.S. Cl. ..... 204/217; 204/224 R; 204/224 M; 204/226

[58] Field of Search ..... 204/224 R, 224 M, 225, 204/212, 217, 226

[56] References Cited

U.S. PATENT DOCUMENTS 4,430,165 2/1984 Inoue ..... 204/224 R X
4,497,692 2/1985 Gelchinski et al. ..... 204/224 R X
4,537,670 8/1985 Strand ..... 204/224 R
4,559,115 12/1985 Inoue ..... 204/224 M X
4,826,583 5/1989 Biernaux et al. ..... 204/224 R

*Primary Examiner*—Donald R. Valentine
*Attorney, Agent, or Firm*—Spensley Horn Jubas & Lubitz

[57] ABSTRACT

An optical fine processing apparatus for forming a structure having a high aspect ratio even on a workpiece having high heat conductivity. Light, such as a laser beam, is irradiated onto the workpiece in an electrolytic solution through a light guide to deposit a substance such as a metal or a polymer. A plurality of removal electrodes are allowed to have an electric potential for removing a part of the deposited substance. The removal electrodes are disposed in a rotation ring which is rotatable about the optical axis of the irradiating light onto the sample so as to adjust the width of a predetermined pattern to be scraped by changing the rotation angle of the removal electrodes with respect to the optical axis. By scanning the light guide and the removing electrodes above the workpiece surface, it is possible to form any desired pattern on the workpiece.

5 Claims, 2 Drawing Sheets

OPTICAL FINE PROCESSING APPARATUS

BACKGROUND OF THE INVENTION

The present invention relates to a fine processing apparatus for optically and chemically performing addition processing and removal processing of metal or the like in a solution in order to produce a patterned structure having a high aspect ratio, which is especially used in fields in which structures are fabricated using micromachining techniques.

One example of a conventional fine processing apparatus is shown in FIG. 3.

A sample, or workpiece, 10, a counter electrode 32 and a reference electrode 31 are immersed in a solution (plating solution) 16, the electric potential of the counter electrode 32 is set in a state of an equilibrium electric potential or a small overvoltage of a value at which no deposition occurs, and light 1 from a laser apparatus 20 is concentrated and irradiated onto sample 10 through a lens 21. The plating speed rapidly increases at the portion irradiated by the light 1, and a substance is deposited, or plated, only at the irradiated portion. At this time, when the laser beam is made to scan the surface of sample 10, a linear pattern of deposited substance can be drawn.

The principle of this deposition can be explained as follows. Namely, when the laser irradiates the electrode surface of the sample in the solution, and its energy is absorbed by the irradiated portion of the sample, the interface between the electrode and the solution is locally heated. The local heating promotes the electric charge migration reaction which results in the deposition.

However, in the conventional fine processing method, as shown in FIG. 4, the deposited substance 5 having a film thickness distribution as shown in the FIG. 4 is generated at the surface portion of sample 10 which is irradiated by the light. This is considered to be due to the temperature distribution in accordance with the light irradiation. In the case of a raw material having good heat conductivity, the heat generated by the absorption of the light is rapidly diffused. Thus, the film is formed to have a shape extending over the irradiated portion. In addition, in the case of laser light, the intensity of the laser beam gives a normal Gaussian distribution, so that the film thickness distribution provides a hill-like cross section as shown in FIG. 4.

Thus, in order to suppress the influence of the heat diffusion, there have been tried a method in which a substance having low heat conductivity is thinly coated on the sample, a method in which a pulse oscillation laser is used to make the heat release satisfactory so as to decrease the influence of the heat diffusion etc.; however, no satisfactory solution has been achieved.

SUMMARY OF THE INVENTION

It is an object of the present invention to provide an optical fine processing apparatus for forming a metal or polymer film pattern having sharp pattern edges and a high aspect ratio even on a sample material having a high heat conductivity.

In order to achieve the above-mentioned and other objects, in this invention, the edge portions of a metal or polymer pattern to be deposited are removed with the aid of a film formation component in which removing electrodes are arranged in the vicinity of a light guide for delivering the light.

In addition, the light irradiation and the application of an electric potential to the removing electrodes in the vicinity of the light are performed alternately for in the form of pulses, whereby it is made possible to scrape the deposited metal or polymer electrochemically.

Further, there is provided a mechanism such that the removing electrodes for scraping the pattern edge portions rotate about the center of the optical axis, and the removing electrodes are allowed to rotate with respect to the optical axis to an angular position which may be changed, whereby the width of the pattern to be scraped can be adjusted.

The light, such as a laser beam, is directed to irradiate the sample in the solution. The metal or polymer is deposited at the portion irradiated by the laser beam. The removing electrodes are allowed to have an electric potential for removing the deposited substance, and the metal or polymer is scraped at the pattern edge portions.

By scanning the film formation component relative to the sample, it is possible to form an arbitrarily selected pattern on the sample. The removing electrodes for scraping are made capable of rotational movement with respect to the optical axis of the light beam, whereby the width of the pattern to be scraped can be adjusted, and control of the pattern width can be performed.

DESCRIPTION OF THE PREFERRED EMBODIMENTS

An example of this invention will be described hereinafter with reference to the drawings.

Figure 1:
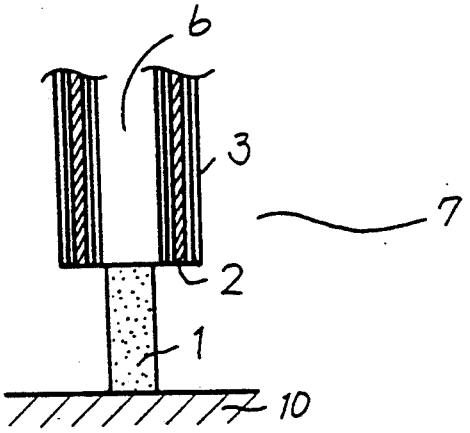
FIG. 1 is an elevational cross-sectional view of an embodiment of a film formation component to be used for the fine processing apparatus of the present invention.
Figure 2:
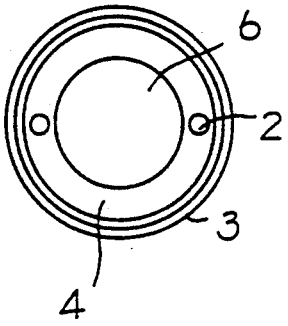
FIG. 2 is a bottom plan view of the film formation component of FIG. 1.
Figure 3:
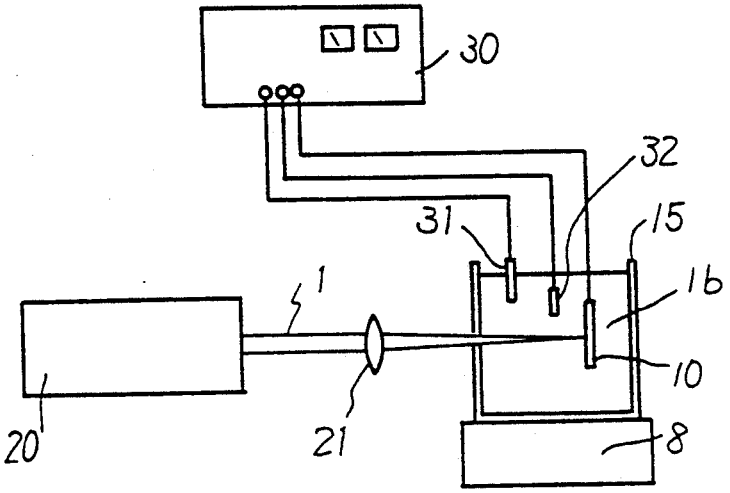
FIG. 3 PRIOR ART
FIG. 3 is a simplified elevational view of a conventional fine processing apparatus.
Figure 4:
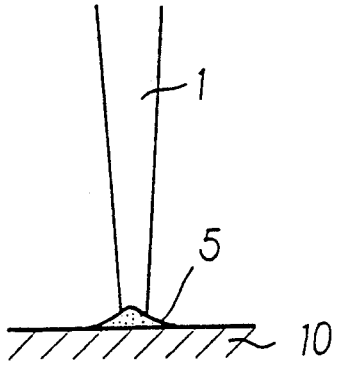
FIG. 4 PRIOR ART
FIG. 4 is a pictorial view illustrating the conventional film formation process using light.

FIGS. 1 and 2 show the structure of a film formation component 7, which is constituted by a light guide 6 for transmitting a light beam, an electrical insulating tube 3, a rotation ring 4 and removing electrodes 2.

The removing electrodes 2 are formed of a metal such as tungsten, platinum or the like, and are supported by rotation ring 4 for rotating the removing electrodes 2 about the axis of the light beam. The rotation ring 4 is made of an electrical insulating material. This rotation ring 4 is further supported by the insulating tube 3. Light passes through the region enclosed by rotation ring 4 and irradiates a sample 10.

According to an exemplary practical embodiment, rotation ring 4 has an inner diameter of the order of 500 microns and light guide 6 has the same, or approximately the same, diameter. Each of electrodes 2 supported in rotation ring 4 has a diameter of the order of 100 microns.

Figure 5:
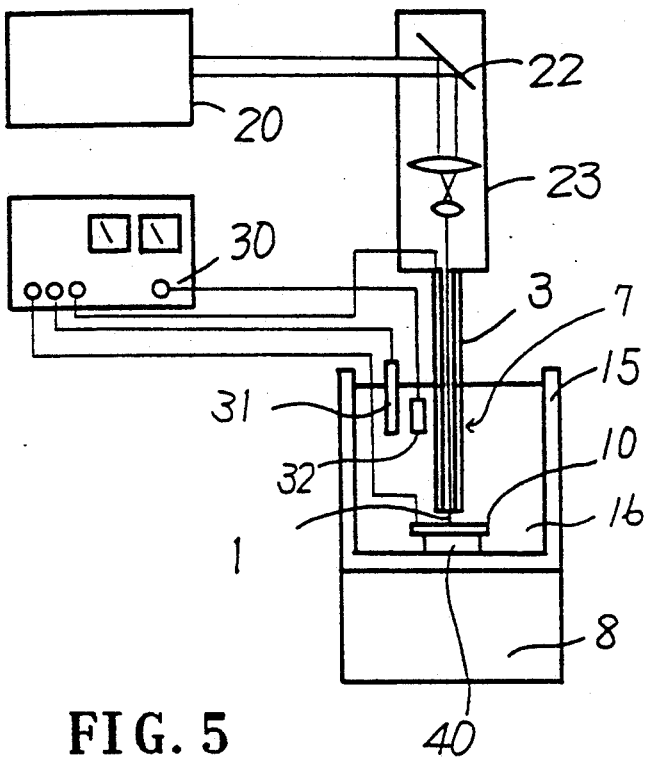
FIG. 5 is a simplified elevational view of an embodiment of a fine processing apparatus according to the present invention, provided with the component of FIGS. 1 and 2.

FIG. 5 shows an example of a fine processing apparatus of the present invention.

The interior of a container 15 is provided with sample, or workpiece, 10, a reference electrode 31 and a film formation component 7, and is filled with a solution 16. Further, the sample 10, the reference electrode 31 and the removing electrodes 2 of film formation component 7 are electrically connected to a potentiostat 30. The sample 10 may be either an electrically conductive substance or an insulator coated with an electrically conductive substance. The reference electrode 31 is an electrode for generating an electric potential to serve as a standard for the case of controlling the electrode electric potential in the electrochemical reaction, for which a saturated calomel electrode (SCE) or a silver-silver chloride electrode is generally used. For the counter electrode 32, tungsten or platinum is used. The container 15 is installed on a vibration-isolation stand 8.

Light is generated by a laser apparatus 20, the being deflected by a reflection mirror 22. The reflected light is concentrated by an optical system so as to generate a collimated light beam.

A pattern drawing method will now be described. An X-Y driving system, not shown in the figure, exists under a sample stand 40 for supporting the sample, which moves the sample in the X-Y plane, which is horizontal in the arrangement of FIG. 5. With respect to movement in the Z axis direction, when a laser beam is used, its coherence property is high, so that there is no problem.

In addition, an optical housing 23 directly supports insulating tube 3, so as to avoid the absorption of light due to the reaction by the solution 16 as thoroughly as possible.

A method for performing film formation of a chromium film using the present apparatus will now be described.

A mixed solution of chromic acid and sulfuric acid is provided in the container 16, and the sample 10, the reference electrode 31 and the counter electrode 32 are immersed in the container 15. Further, the sample 10, the reference electrode 31 and the counter electrode 32 are connected to the potentiostat 30. The sample 10 is moved to bring a portion of its surface at which a desired pattern is intended to be obtained beneath component 7 by means of the X-Y driving mechanism (not shown in the figure but installed in sample stand 40). The light generated by the laser apparatus 20 passes through the optical system in the optical housing 23, passes through the region enclosed by rotation ring 4 in the insulating tube 3, and is irradiated onto the sample 10. On the sample surface, reaction occurs and a thin film of chromium is formed. Next, an electric potential for removing is applied to removing electrodes 2 installed in rotation ring 4, whereby the edge portions of the formed thin film are scraped away.

For pattern formation, the light is generated in the form of pulses to form a pattern, and the electric potential to scraping electrodes 2 is also in the form of pulses to remove the pattern edge portions, and when such steps are alternately performed for each pulse, i.e. the light pulses alternate with the scraping potential pulses, it is possible to perform the addition, or deposition, processing and the removal processing, and a pattern with sharp, or steep and abrupt, edge portions and a high aspect ratio can be obtained.

Figure 6A:
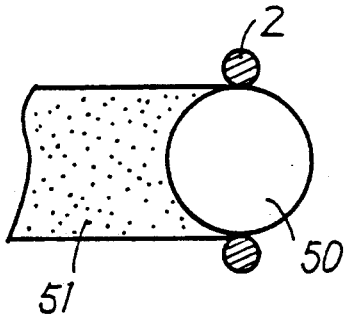
FIG. 6A and 6B are simplified pictorial views showing the pattern width control method using the fine processing apparatus according to the present invention.
Figure 6B:
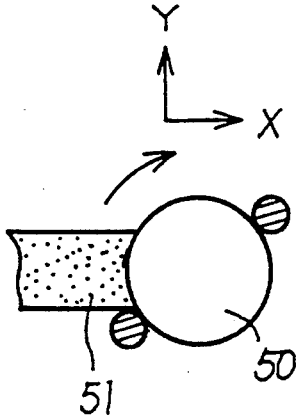

A control method for controlling the pattern width will now be described with reference to FIGS. 6A and 6B. In FIG. 6A a case is shown in which the film formation is performed while rotation ring 4 is oriented about the light beam axis so that each removal electrode 2 is centered on a line which is parallel to the X-Y plane, passes through the light beam axis and extends perpendicular to the direction of scanning of component 7 relative to the surface of workpiece 10. On the other hand, a case is shown in FIG. 6B in which the rotation ring 4 is rotated about the optical axis by about 45 degrees. When the rotation ring 4 is rotated about the optical axis by about 45 degrees, removal electrodes 2 will act to narrow the width of the pattern, relative to that produced when ring 4 has the orientation shown in FIG. 6A. By this method, the pattern width is controlled to obtain a pattern having a desired width.

In this invention, as explained above, with respect to the apparatus in which the sample 10, the counter electrode 32 and the reference electrode 31 are installed in the solution, and the light 1 is irradiated onto the sample, whereby a desired pattern consisting of metal or polymer is formed, the removing electrodes 2 are arranged in the vicinity of the light 1, electric current is allowed to flow between the removing electrodes 2 and the sample 10 to cause electrochemical reaction so as to remove a part of the metal or polymer, whereby there is provided such an effect that a structure is obtained which has a sharp pattern edge and a high aspect ratio.

This application relates to subject matter disclosed in Japanese Application number 4-74732, filed on Mar. 30, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An optical fine processing apparatus for forming a structure constituted by a deposited substance on a workpiece, comprising: a container adapted to be filled with an electrolytic solution in which the workpiece is to be immersed; a light guide having a light output end adapted for immersion in the electrolytic solution and adapted for irradiation of the workpiece with light in order to effect deposition of a substance from the electrolytic solution onto the workpiece by optical energy; at least one removal electrode disposed adjacent to said light guide and connected to receive an electric potential selected for scraping a part of the deposited substance from the workpiece by electrochemical reaction; light generating means for supplying light to said light guide through an optical system; and potential supplying means for supplying the electric potential to said removal electrode.

2. An optical fine processing apparatus according to claim 1, wherein said light generating means and said potential supplying means alternately supply light to said light guide for depositing the substance and the electric potential to said removal electrode for scraping a part of the deposited substance, respectively, and wherein said light guide and said removal electrode are movable relative to the workpiece to give the structure a predetermined pattern.

3. An optical fine processing apparatus according to claim 1, further comprising a rotation ring surrounding said light guide and wherein there is a plurality of removal electrodes carried by said rotation ring, said rotation ring being rotatable about the optical axis of the light guide so as to adjust the width of the structure formed after scraping of deposited substance by action of said removal electrodes.

4. An optical fine processing apparatus according to claim 1, wherein the substance deposited on the workpiece is a metal.

5. An optical fine processing apparatus according to claim 1, wherein the substance deposited on the workpiece is a polymer.

* * * * *